US005158138A

United States Patent [19]

DeCuir, Sr.

[11] Patent Number: 5,158,138

[45] Date of Patent: Oct. 27, 1992

[54] APPARATUS FOR SHUTTING IN A BURNING OIL WELL

[76] Inventor: Perry J. DeCuir, Sr., P.O. Box 11951, New Iberia, La. 70562-1951

[21] Appl. No.: 856,521

[22] Filed: Mar. 24, 1992

Related U.S. Application Data

[62] Division of Ser. No. 726,582, Jul. 8, 1991, Pat. No. 5,121,797.

[51] Int. Cl.[5] ..... E21B 33/03; E21B 34/02; E21B 35/00

[52] U.S. Cl. ..... 166/90; 166/95; 166/97; 169/69

[58] Field of Search ..... 166/90, 95, 97, 79, 166/75.1, 70, 363, 364; 169/69

[56] References Cited

U.S. PATENT DOCUMENTS

| | | | |
|---|---|---|---|
| 3,943,997 | 3/1976 | Davis | 166/90 X |
| 4,290,482 | 9/1981 | Brisco | 166/90 X |
| 4,318,442 | 3/1982 | Lunde et al. | 166/79 X |
| 4,828,025 | 5/1989 | Gonzales | 166/97 X |
| 4,972,904 | 11/1990 | Godare | 166/97 X |
| 5,012,865 | 5/1991 | McLeod | 166/90 |

*Primary Examiner*—Stephen J. Novosad
*Attorney, Agent, or Firm*—Dodge, Bush, Moseley & Riddle

[57] ABSTRACT

In accordance with illustrative embodiments of the present invention, an oil well fire fighting vehicle includes a reciprocated cable mechanism to cut off damaged well casing above ground level, and a slot region and gripping members that attach the vehicle to the cut-off casing when the vehicle is positioned thereover. A diverter deflects the oil flow away from the front of the vehicle, and a packer and valve assembly are forced down into the casing to pack-off the same and confine the oil flow to the valve which can be closed to shut in the well. Various heads for controlling the flow of oil from the well also are disclosed.

4 Claims, 4 Drawing Sheets

APPARATUS FOR SHUTTING IN A BURNING OIL WELL

This application is a divisional of application Ser. No. 07/726,582 filed Jul. 8, 1991, now U.S. Pat. No. 5,121,797.

FIELD OF THE INVENTION

This invention relates generally to unique methods and apparatus for shutting in a burning oil well in order to extinguish the fire, and particularly to a new and improved special purpose vehicle and technique for cutting off the top portion of the well casing of a burning well and then setting in the casing a packer having a flow control valve to enable the well to be shut in by closing the valve.

BACKGROUND OF THE INVENTION

Recent events in the hundred day way between the Coalition Forces and Iraq demonstrated that terrorism in the form of setting oil wells on fire can have severe economic and environmental consequences. Of course the burning of crude oil that otherwise would be used locally or sold on the world market damages the producer's economy, and can have an impact on the world market price of oil where the producer has substantial sales. The thick black cloud of smoke that is produced particularly when a large number of wells are on fire, severely reduces the amount of sun light that reaches the ground. This can have immediate as well as long term effects on the ecology of the region that is covered by smoke. Therefore, it is imperative that the fire of any burning oil well be extinguished, and the well but back into production, as quickly as possible. Of course this holds true for any land-based or offshore well that is burning out of control.

An oil well fire is not easy to extinguish. A huge and extremely hot flame is produced which has the general characteristics of the flame of a blow torch due to the high velocity of the flow of oil or gas as it escapes from the top of the well into the atmosphere. There is a vertical region immediately above the top of the casing where the oil flows unignited, i.e., before the flame front begins. A common method of putting out this type of fire is to cool the top of the well and the surrounding areas by large amounts of sprayed water, move a vehicle that has an explosive charge on the end of a long boom close enough so that the charge is adjacent the vertical region mentioned above, then set off the charge. The explosion of the charge uses substantially all available oxygen in the region between the top of the well and the flame front so that the flame is extinguished. Then a special valve head is lowered over the top of the well casing and clamped in place. One or more normally open valves in the head can be closed by remote control to shut in the well.

Although the foregoing technique has been widely used, it has a number of shortcomings. The principle disadvantage is that there is a relatively long time lapse between the event of exploding the charge to extinguish the flame, and the setting of the valve head on the top of the well. At any time, the fire can be rekindled due to hot metal parts and debris in the area, and the flame extinguishing procedure then will have to be repeated. This time lapse is extremely dangerous to persons who are operating the equipment, and might be near the well when it reignites. Another. disadvantages is that the explosive may not extinguish the flame, or extinguish it only temporarily, both of which produce delay and continuing dangerous conditions.

An object of the present invention is to provide a new and improved method and apparatus for quickly shutting off the flow of oil from a burning well.

Another object of the present invention is to provide a new and improved process for cutting off the top of the casing and setting a packer in the casing below the cut in a substantially continuous process and operation that can be quickly carried out.

SUMMARY OF THE INVENTION

These and other objects are attained in accordance with the present invention through the provision of a unique fire fighting vehicle that includes a base having ground-engaging means such as tracks on each side to move the vehicle over the ground, and an elongated frame fixed to the front end of the base which carries pulleys at each front corner and a jib-type boom that can be used for hoisting. If desired, an elongated pipe having a bell-shaped lower end portion can be positioned over the well head to move the flame front higher in the air. A cable adapted to cut off the casing near ground level passes around the pulleys and is reciprocated by a cylinder that can be mounted on the side of the vehicle, while a second gas-charged cylinder that is attached to the cable maintains a suitable amount of tension therein. Such reciprocation causes the top part of the casing to be cut off, after which it can be moved out of the way by the boom. Spray nozzles are provided on the front of the frame to provide cooling water sprays during the cutting process, and a pair of large fans powered by hydraulic motors operate to blow the heat and flame away from the front of the vehicle.

The base carries an assembly including a clamping slot and heat shields. A vee-shaped guide leads to the slot which causes the vehicle to be automatically aligned with the casing as the vehicle is moved forward. A pair of oppositely movable clamps are arranged on the sides of the slot and are automatically operated as the cut-off pipe enters the slot to temporarily attach the vehicle to the pipe. A flow deflector is pivoted to the heat shields on either side of the slot, and causes the path of the oil stream issuing from the top of the casing to be defected outward and away from the vehicle.

Once the vehicle is clamped to the pipe, a special packer assembly is forced toward the casing past the deflector, and is snubbed into the casing and set. A value located in a tubular member extending above the packer than can be closed to shut in the well. The entire procedure including cutting off the pipe and setting the packer takes a relatively short period of time, and does not require that any explosive charge be used. The controls for the vehicle and for various other functions can be located and operated remotely so that no one is near the well during any part of the process.

In accordance with another aspect of the present invention, an oil flow diverter head is positioned over the cut-off pipe portion, and its lower portion is sealed with respect thereto to prevent wash out of earth around the pipe. The diverter head includes an upper branch and a side branch through which oil flow is controlled by valves. The valves are actuated in a manner such that when one valve is closed the other is open, and vice-versa.

BRIEF DESCRIPTION OF THE DRAWINGS

The present invention has other objects, features and advantages that will become more clearly apparent in connection with the following detailed description of a preferred embodiment, taken in conjunction with the appended drawings in which.

DETAILED DESCRIPTION OF A PREFERRED EMBODIMENT

Figure 1:
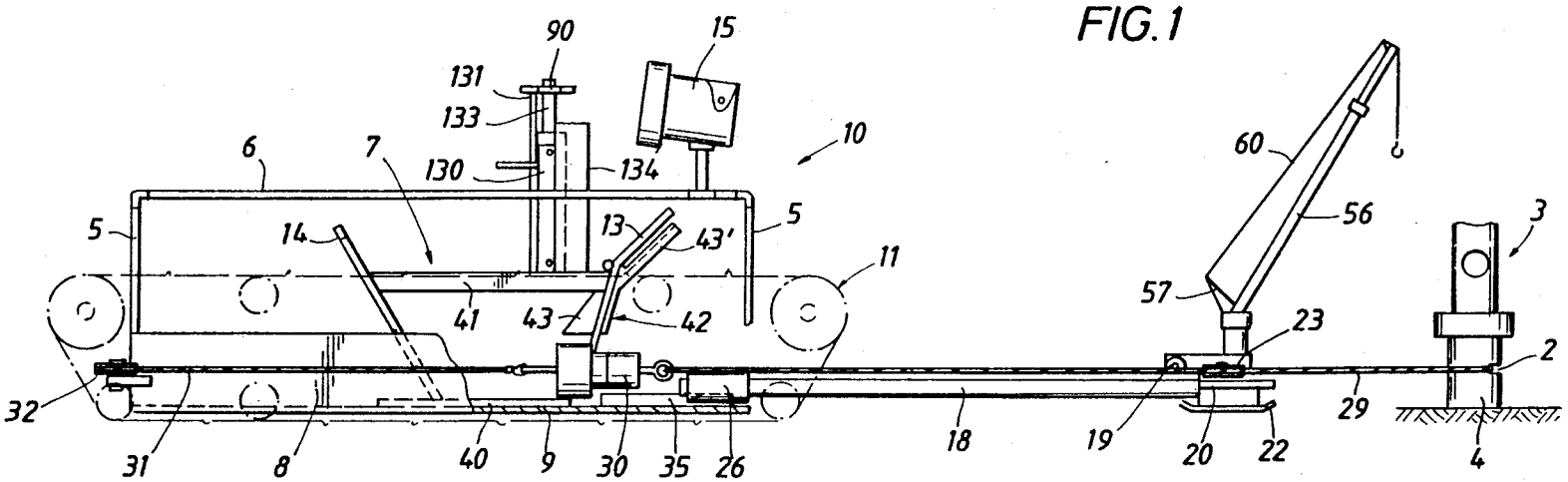
FIG. 1 is a side elevational view of the vehicle of the present invention.
Figure 2:
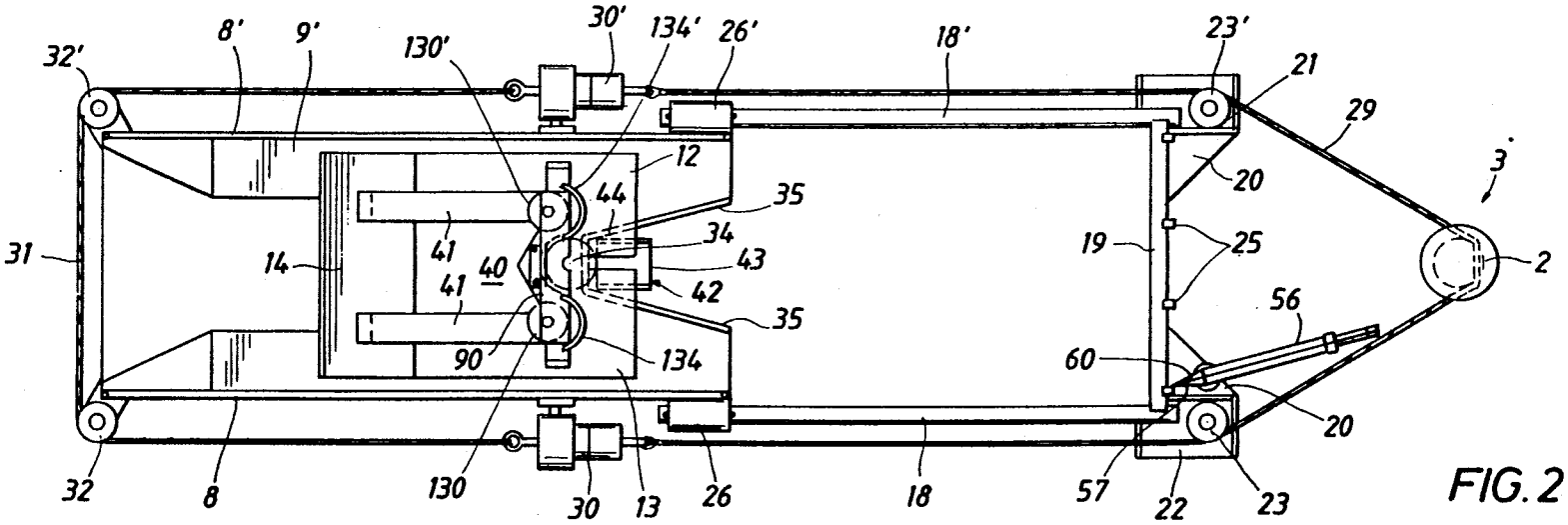
FIG. 2 is top view of the vehicle of FIG. 1.

Referring initially to FIGS. 1 and 2, an apparatus in accordance with the concepts of the present invention comprises a vehicle indicated generally at 10 which includes elongated metal base members 9 having the side walls 8, 8'. The base members 9 can be mounted by suitable suspension on endless tracks 11 (shown in phantom lines) on each side for propelling the vehicle 10 over the ground. Although endless tracks are shown, other types of ground-engaging means could be used, such as cleared steel wheels. The ground-engaging means preferably is driven by hydraulic motors via suitable controls which allow the vehicle 10 to move forward and in reverse and to turn to the right or the left. A well shut-in assembly indicated generally at 7 is fixed by welding or the like to the base 9 and includes a pair of front heat shield plates 12 and 13 which provide a protection for various hydraulic cylinders and lines located immediately therebehind, as will be discussed below, and a rear heat shield plate 14 that provides further protection for power packs, accumulators and lines located rearward thereof. The front and rear shields 12–14 are joined by parallel beams 41 having their ends welded thereto. The assembly 7 also has a metal base 40 that is joined to the lower edges of the shields 12–to provide a rugged and sturdy construction. The base 9 has hand rails 6 mounted on standards 5 on each side, and a pair of large fans or blowers 15, 15' are attached to the hand rails about midway of the vehicle 10. The fans 15, 15' also are driven by hydraulic motors, and function to provide high velocity air streams that blow heat, smoke and the flame away from the front of the vehicle. The fans 15, 15 can be adjusted longitudinally along the rails 6, and also can be oriented by remote control.

The front of the base 9 has collars 26 welded to each side that receive the ends of a pair of forwardly extending tubes 18, 18' which are joined at their outer ends by a tubular cross member 19. Brace plates 20 and vertical walls 21 join the tubes 18 to foot-plates 22 at each corner, where pulleys 23, 23' are mounted in horizontal positions. The cross member 19 has a plurality of water nozzles 25 that are fed with water under high pressure to produce sprays in the forward direction to cool the metal parts of the well head. Water under pressure can be fed to the nozzles 25 through the tubes 18, 18' so that separate hoses or pipes are not needed. A cable 29 that is adapted to cut off the well pipe 4 by reciprocating movement extends around the pulleys 23, 23' and then rearward to cylinders 30, 30'. The cylinder 30 that is operated by hydraulic fluid under pressure applied to alternate opposite sides of its piston is mounted on the side wall 8 by a suitable bracket as shown. The other cylinder 30' has a piston that is subjected on one side to the pressure of an inert gas such as nitrogen to maintain a suitable amount of tension in the cable 29. This cylinder is not attached to the base, but instead has the forward portion of the cable 29 attached to its rod, and the rear portion of the cable attached to its housing. Thus the gas pressure tends to pull the rod into the housing. The rod on the piston within the cylinder 30 extends out the opposite ends of its housing, and the adjacent ends of the cable 29 are connected by suitable clamps, as shown, to the front and rear portions of the rod. The rear cable section 31 extends toward the rear of the vehicle 10 and around rear pulleys 32, 32' that are mounted by suitable brackets in horizontal portions on the rear corners of the side walls 8.

The front portion of the cable 29 is looped over the damaged well head 3 and is positioned at a cut-off point 2 on the casing 4, and then the slack is taken out by rearward movement of the vehicle 10. Alternate application of hydraulic fluid under pressure to the opposite sides of the piston of the cylinder 30 causes the cable 29 to reciprocate under tension and thereby saw off the pipe. To facilitate the cutting action, the front-most section of the cable 29 can be provided with longitudinally spaced steel balls having tungsten carbide or industrial diamond inserts.

Figure 4:
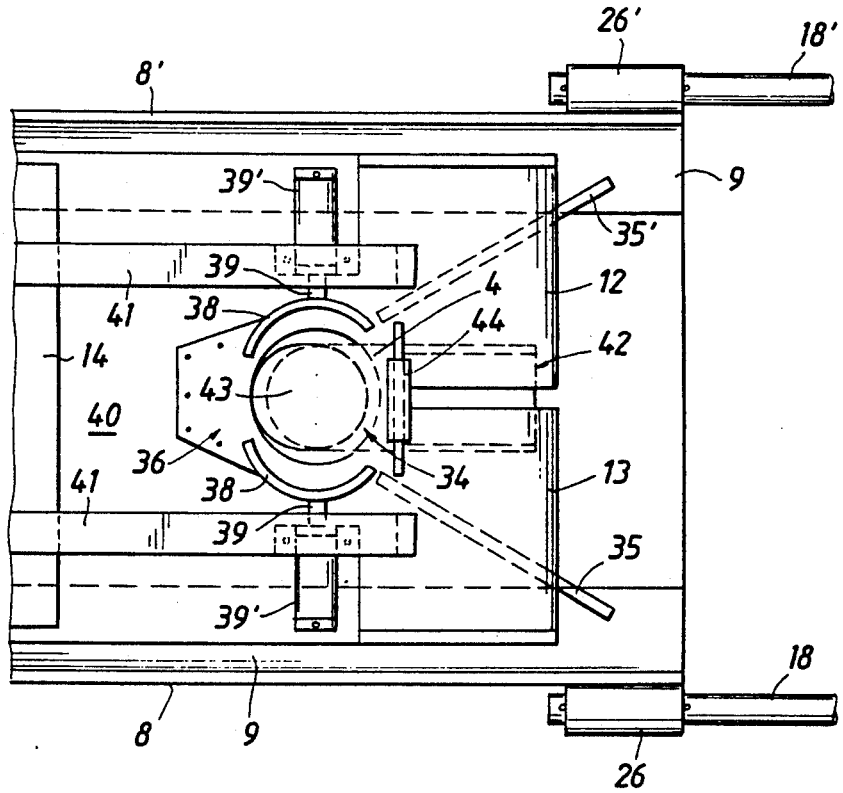
FIG. 4 is an enlarged, fragmentary top view of the pipe clamping slot and associated structure.

The lower portion of the space between the heat shields 12 and 13 forms a slot area 34 having oppositely inclined, horizontal guide rails 35,35' leading thereto. A clamp assembly 36 arranged adjacent the slot 34 includes a pair of oppositely arranged jaws 38 mounted on the outer ends of the rods 39 of hydraulic cylinder 39' as shown in FIG. 4. The cylinder 39' are fixed to the floor of the assembly 8 by brackets as shown. The jaws 38 are generally semicircular and are sized to snugly engage the outer surfaces of the well casing 4 below the cut 2 therethrough that was made by reciprocation of the cable 29, and when shifted simultaneously inward function to rigidly clamp the vehicle 10 to the casing step. The jaws 38 can have teeth (not shown) that bite into the outer walls of the casing stub 4. Alternatively the jaws 38 can have wedge-shaped slips with upwardly facing teeth that more firmly grip the casing stub in response to any tendency of the jaws to be forced relatively upward.

An oil flow deflector member 42 is pivoted on a transverse axis 44 to the shields 12, 13 above the jaws 38. As shown more clearly in FIG. 3, the member 42 has a shovel-shaped lower portion 43 ad a shallow, U-shaped upper portion 43' that are inclined relative to one anther at the pivot axis 44. When the jaws 38 grip the pipe, the member 42 is positioned such that the lower and the upper portions thereof divert the flow of oil outward and forward of the vehicle 10 in order to move the flame away from over the well casing 4. The deflector member 42 is automatically pivoted to an out-of-the-way position, as will be described below, by the lowering of a packer assembly that is to be set in the casing 4.

A boom 56 is mounted on a swivel base 57 of the structural brace 20 at the right front corner of the vehicle. 10. The boom 56 has a jib 57 at its lower end, and a cable 60 extends over the outer end of the jib and then over the upper end of the boom. The cable 60 is operated by remote control to lift and remove objects, such as the damaged well head portion 3 above the cut-off point 2.

Figure 5A:
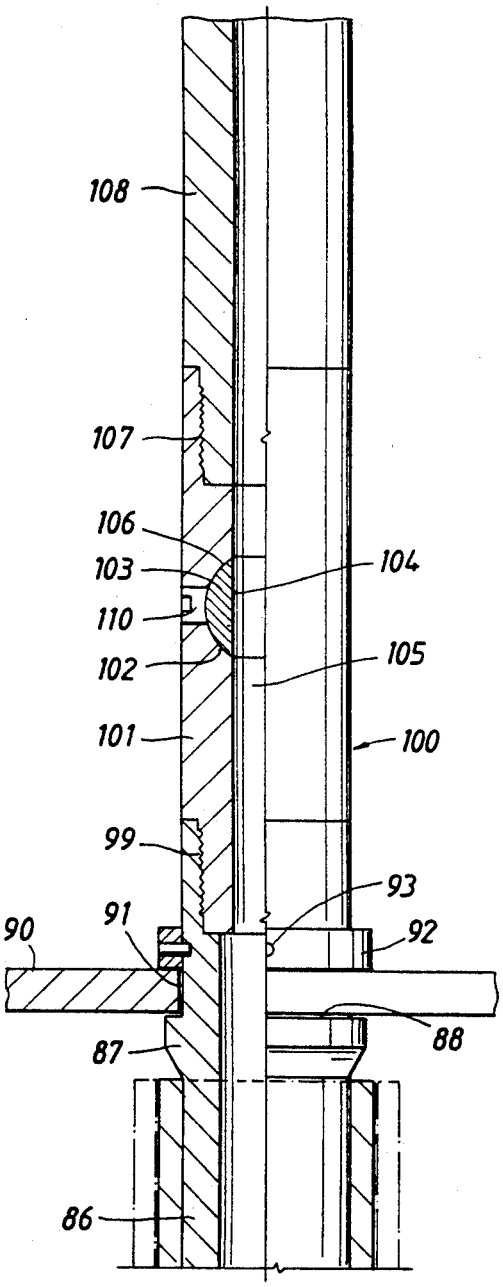
FIG. 5A and 5B are longitudinal sectional views of the packer and flow control valve used in the present invention.
Figure 5B:
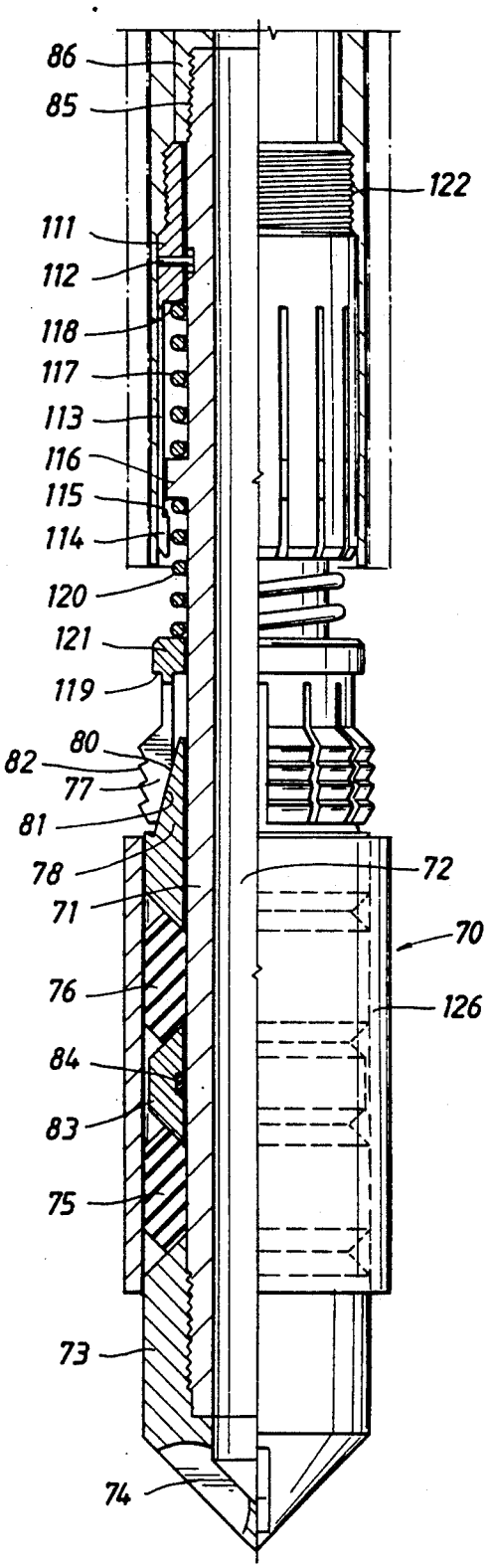

A combination packer and flow control valve assembly that is used to shut off the flow of oil from out of the top of the casing 4 is shown in FIGS. 5A and 5B. The packer 70 includes a central body or mandrel 71 having an internal bore 72 and an abutment 73 fixed to its lower end. Flow ports 74 are provided to communicate the interior of the casing below the abutment 73 with the bore 72. Normally retracted means in the form of packer elements 75, 76 to seal off annular between the mandrel 71 and the casing, the slips 77 to anchor against upward movement, are mounted on the outside of the mandrel 71. An expander cone 78 has an upward and inwardly inclined external surface 80 that coacts with inclined rear surfaces 81 on the slips 77 to shift the slips outward in response to longitudinal relative movement. Once the upwardly facing teeth 82 on the slips 77 grip the casing wall, the packer elements 75, 76 are expanded as the lower abutment 73 moves relatively upward. A spacer 83 having an internal seal ring 84 can be positioned between the packer elements 75, 76.

The mandrel 71 is elongated above the packer assembly 70 and is threaded at 85 to a running sub 86. The sub 86 has an outwardly directed flange 87 that provides an upwardly facing annular drive shoulder 88. A drive bar 90 having an opening 91 engages the shoulder 88 to provide a means whereby the packer assembly 70 can be driven or snubbed into the casing under pressure. A stop ring 92 is fixed above the bar 90 by a plurality of pins 93 to prevent upward movement of the drive bar 90 relative to the sub 86. The pins 93 can be sheared by a predetermined upward force on the bar 90 once the packer is set, and the ball valve mentioned below can be automatically closed in response to upward movement of the ring 92.

A valve assembly 100 is threaded at 99 to the upper end of the running sub 86, and includes a tubular body 101 having a spherical cavity 102 that receives a ball valve element 103. The ball element 103 can rotate about a transverse axis between an open position where its bore 104 is aligned with the body passage 105, and a closed position where its bore 104 is at a right angle to the passage 105. In the closed position, an external surface of the ball element 103 engages a seat 106 to block upward flow of fluids. The ball element 103 can be rotated by fitting an actuator handle (not shown) into a radially extending member 110 that is connected to the ball, and applying torque. Alternatively, the ball valve 103 can be coupled to an actuator that is remotely controlled. The upper end of the valve body 101 is threaded at 107 to a spacer sub 108 that extends upward a suitable distance.

As shown in FIG. 5B, a pulling sleeve 111 that is releasably connected to the mandrel 71 by a shear pin 112 has a plurality of depending fingers 113 having heads 114 with undercut internal shoulders 115. The heads 114 normally are positioned below an outwardly directed shoulder 116 on the mandrel 71. An upper coil spring 117 reacts between the shoulder 116 and a downwardly facing shoulder 118 on the pulling sleeve 111, and a lower coil spring 120 reacts between the shoulder and an annular section 121 that joins the upper ends of the slip segments 77 together. The pulling sleeve 111 has external threads 122 that engage internal threads on a releasing sub 124. Rotation of the release sub 124 relative to the mandrel 71 will shear the pin 112 and cause the pulling sleeve 111 to shift downward along the mandrel until the heads 114 are below the section 121. Then upward movement of the pulling sleeve 111 will cause the undercut surfaces 115 to engage companion surfaces 119 on the sip section 121 and pull the slips 77 upward relative to the expander cone 78.

The packing elements 75, 76 initially are covered by a protection sleeve 126 having a friction fit thereover. The sleeve 126 covers and shields the packing elements 76, 76 from heat while the packer assembly 70 is being positioned over the casing 4. As the packer assembly 70 is lowered, the sleeve 126 engages the top of the casing stub 4 and its stopped thereby. As shown in phantom lines in FIGS. 5A and 5B, the final position of the sleeve 126 is adjacent the drive bar 90, surrounding the pulling tool 111.

The slip segments 77 are sized such that their teeth 82 drag against the inner walls of the casing during downward movement of the packer assembly 70. When the mandrel 71 is first moved slightly upward, the slips 77 immediately bit into the casing wall and are tigthened thereagainst by the expander cone 78. Additional upward movement of the mandrel 71 foreshortens and expands the packer elements 76, 76 into sealing engagement with the casing wall. Once the packer elements and the slips are set, pressure in the casing 4 below the packer assembly holds them and the slips 77 in set condition. Also, once the packer elements 75, 76 obtain as seal against the casing wall, the flow restriction through the passage 105 of the valve body 101 produces upward force on the mandrel 71 and the abutment 73 which fully expands the packer elements.

The force or drive bar 90 is fixed to the upper ends of the rods of a pair of cylinder 130, 130' that are mounted in vertical positions on the beams 41 which are fixed between the front heat shields 12, 13 and a rear head shield. The cylinders 130, 130' are double acting, so that retraction of the rods 133, 133' will snub the packer assembly 70 into the upper section of the casing 4. As the packer 70 moves downward, the abutment 73 engages the lower portion 43 of the flow diverter 42 and pivots it forward and out of the way. The cylinders 130, 130' preferably are protected by upstanding semi-circular shields 134, 134' located directly in front of them and fixed at their lower ends to the beams 4. To further stabilize and guide the force bar 90 as it moves vertically, a pair of rods 131 can have their lower ends attached to a frame member 132 and extend upward through respective holes in the bar 90.

To remove the packer assembly 70 from the casing, the pulling sub 86 is rotated to advance the sleeve 111 downward. The heads of the fingers 113 will shift out over the ring 121, and the undercut surfaces 115 will automatically engage the companion surface 119 on the ring 121. Then an upward force will pull the slips 77 upward relative to the expander cone 78 to allow them to be shifted inward and released from the anchoring condition. Once the slips 77 release, the packing elements 75, 76 will automatically retract on account of their resilience. Then the packer assembly 70 can be removed from the casing by lifting the same upward, or by allowing it to move upward under the restraint of the bar 90.

Figure 6:
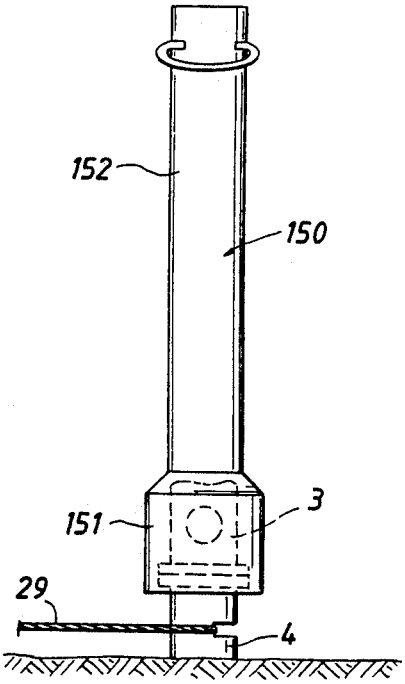
FIG. 6 is a front elevational view of a diverter pipe is position over the well outlet.

During the cable cutting portion of the process, it may be desirable to position a pipe 150 over the remains of the well head 3 to move the flame front higher in the air so as to reduce the likelihood of damage to the forward portions of the vehicle 10. As shown in FIG. 6, the pipe 150 includes a lower, bell-shaped portion 151 that is sized to fit over the well head 3, and an upper, tubular open-topped portion 152 that can have at least the same inside diameter as the corresponding dimension of the casing 4. The pipe 150 can be positioned on the well head 3 by manipulation of the boom 56 and the cable 60 that are mounted on the front of the vehicle 10, and held in the vertical position by the boom during the cable cutting step. The flame front due to combustion of the oil issuing from the well head 3 is moved up above the upper end of the portion 152 so that the region around the well head 3 is not as hot. Once the cable cutting is completed, the boom 56 and cable 60 are used to move the pipe 150 to the side so that the vehicle 10 can be driven forward. During forward movement the cut off casing 4 passes underneath the cross member 19 as the slot 34 is moved toward it. A lifting handle 153 can be mounted near the upper end of the pipe portion 152 to facilitate handling the pipe 150.

Figure 7:
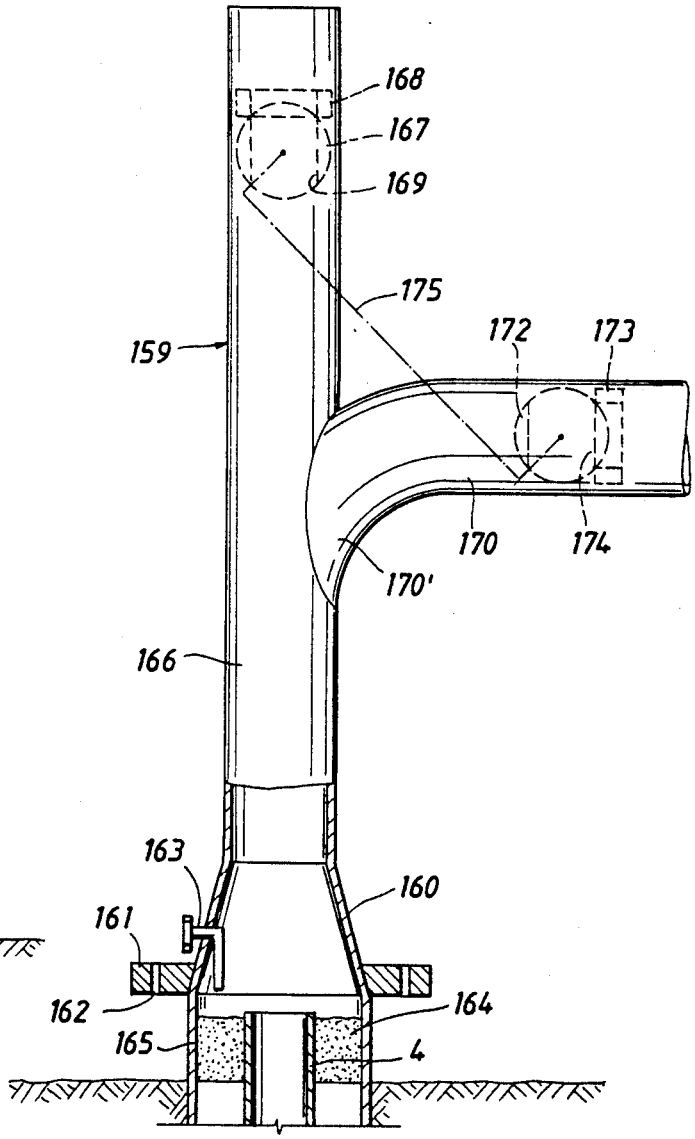
FIG. 7 is a view similar to FIG. 6 of another flow head assembly.

Another assembly 159 for controlling the flow of oil from the casing 4 is shown in FIG. 7. This device can be used as a stand-alone unit to control a well fire, as an alternative to use of the equipment described above. Here the assembly includes a lower frusto conical portion 160 that diverges downward and outward, the portion 160 having a heavy, outwardly extending flange 161 attached to its lower outer periphery. For example the flange 161 can have an outer diameter of about eight (8) feet, and a thickness of about four (4) inches. Suitable holes 162 can be provided to attach additional weights to the flange 161, if needed. A tubular skirt 165 preferably is attached to the lower end of the conical portion 160, and has a length, for example, of 2–4 feet. The skirt 165 engages the ground around the pipe stub 4, which can still have the damaged well head at its upper end, and can sink or be driven into the earth, as shown, to help provide a seal. A connection 163 is provided near the top of the cone 160 to allow quick-setting cement to be pumped into the inside of the skirt 165 where it can set up, as shown at 164, to about two feet high. The cement 164 prevents the earth below the cone 160 from being "washed out", that is, being sucked up into the cone by the combustion of the oil. The connection 163 also allows fire-suppression substances such as halon to be injected into the cone 160.

The upper portion 166 of the assembly is provided by a tubular member that has its lower end welded to the top of the cone 160. It is important that the member 166 has an inner diameter that is at least equal to the inner diameter of the casing 4, and preferably somewhat larger, so that no back pressure due to a flow restriction is formed when the assembly 159 is placed over the casing 4. A ball valve element 167 is mounted near the upper end of the member 166 and is arranged to cooperate with a downwardly facing seat 168. The ball element 167 has a central bore 169 that when aligned with the longitudinal axis of the tubular member 166 allows upward flow, and when positioned at a right angle to such axis closes off fluid flow.

At approximately 3–4 feet above the lower end the member 166, the curved portion 170' at the inner end of another pipe 170 is joined by welding or the like thereto, the pipe 170 extending outward from the pipe member 166. The curvature of the pipe portion 170' reduces upward thrust when flow is diverted to the side. A second ball valve element 172 is mounted in the pipe 170 and cooperates with an inwardly facing set 173 to close the pipe 170 when the bore 174 of the valve element is at a right angle to the longitudinal axis of the pipe 170. When the ball element 172 is rotated to position its bore 174 in alignment with the seat 173, then fluids can flow in the outward direction.

In accordance with one feature of the present invention, the actuators for the ball valves 167 and 172 are ganged together as shown by the dash-dot-dash line 175 in a manner such that when one valve element is open, the other is closed, and vice-versa. Thus any time that oil can flow out the top of the tubular member 166, the side pipe 170 is closed, and when oil can flow out the side pipe 170 the vertical member 166 is closed off. The side pipe 170 can be connected by suitable means to a line that leads to a collection pit (not shown), from where the oil can be piped to a tanker or the like, or directly to such a tanker.

OPERATION

In operation, the vehicle 10, through use of suitable remote controls, is made to approach the burning well 3 until the cross-member 19 is located at an appropriate distance therefrom. If desired, an elongated shallow excavation can be made adjacent the well to provide a smooth working surface and to expose a suitable length of the casing 4 above ground level. With the cross-member 19 positioned close to the wellhead 3, the boom 56 is used to loop the cable 29 over the well head 3 and to position and lower the pipe 150 (FIG. 6) until its lower portion rests on the well head, leaving the casing 4 exposed therebelow. The boom 56 can continue to be used to maintain the pipe 150 in its upright position. The oil flow then begins to burn above the top of the pipe 150, which reduces the heat at the level of the casing 4. Slack is taken out of the cable 29 by backing the vehicle 10 rearward. The cylinder 30 is placed in operation to reciprocate the cable 29 and cut or saw the casing off at the point 2 while the cylinder 30' maintains a selected tension in the cable.

When the pipe cutting operation is completed, the boom 56 can be used to remove and lay aside the pipe 150 and the remains of the well head 3. Then the vehicle 10 is driven forward and the cut off pipe stub 4 passes underneath the cross-member 19. The guide rails 35 automatically bring the pipe stud 4 into the slot area 34. When the casing 4 enters the slot 34 the clamps or jaws 38 are automatically triggered by suitable means and are forced inward by their cylinders 39' to attach the vehicle 10 to the casing stub. The oil flow deflector 42 redirects the oil flow outward and away from the front end of the vehicle 10, and the flow of oil against the shoulder portion 43 holds the deflector in its deflecting position. The fans 15 are in operation to blow smoke and heat away toward to front.

Figure 3:
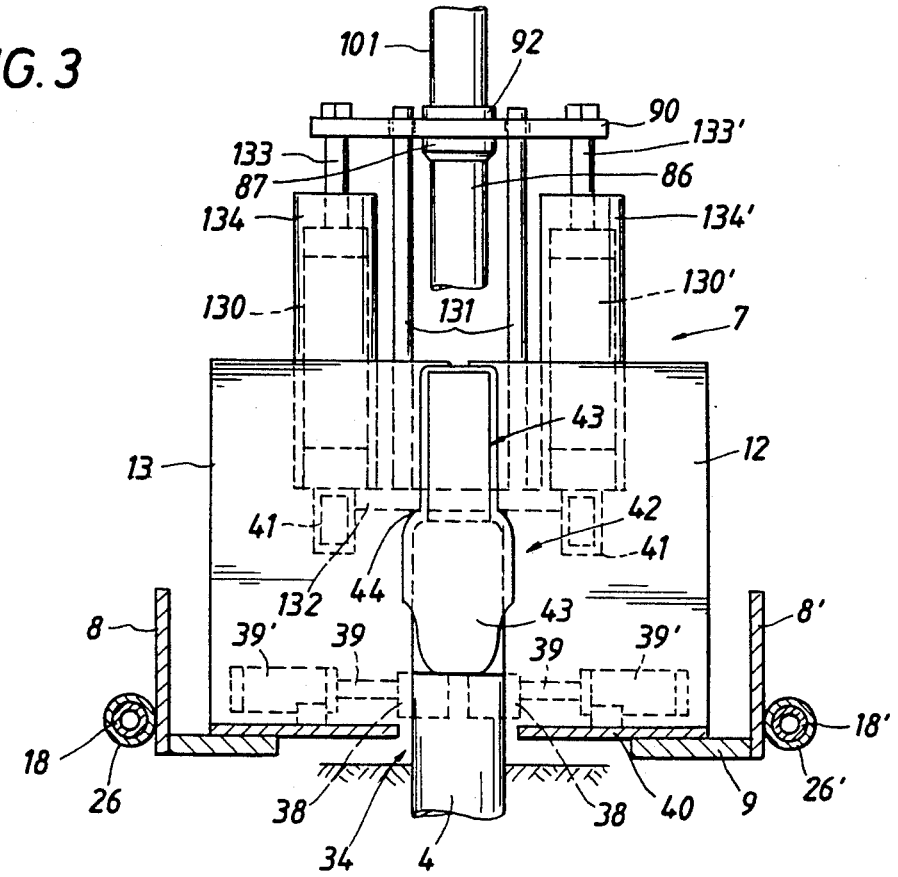
FIG. 3 is an enlarged, fragmentary front view showing the oil deflector and other components.

The packer assembly 20, which is mounted on the drive bar 90 as shown in FIGS. 5 and 3, is automatically suspended in vertical alignment with the casing stub 4 when the jaws 38 engage. Then the hydraulic cylinder 130, 130' are retracted to force the packer 70 down into the casing 4. As the bottom nose 73 of the mandrel 71 encounters the lower portion 43 of the deflector 42, such lower portion is pivoted outward so that the packer can enter the casing 4. The packer assembly 70 is snubbed or forced into the casing 4 against the flow of oil by a suitable distance. The protection 126 engages the top of the casing 4 and is remains stationary as the packer 70 moves downward.

To set the packer 70, the downward force applied to the drive bar 90 is reduced, and the pressure of the flowing oil causes the slips 77 to bite into the inner walls of the casing 4 and be anchored therein by the expander cone 78. The pressure also drives the mandrel 71 relatively upward to expand the packer elements 76, 76. Additional upward force can be applied to the mandrel 71, if necessary to complete the setting, by extension of the cylinder 130, 130'. Once the packer 70 is set, the flow of oil in confined to the bore 105 of the valve body 101 as it passes upward through the ball valve 103. The ball valve 103 can be closed immediately to complete the shut-in of the well.

It will be recognized that once the pipe 4 has been cut off and the vehicle 10 moved forward to position the pipe in the slot area 34, the balance of the sequence of events proceeds rapidly. Once the ball valve 103 has been closed, the force bar 90 can be removed, and the vehicle 10 backed away from the well, which is now under control. The top end of the extension 108 can be connected by suitable piping to a gathering facility such as a storage tank, or to a pipeline that leads toward a shipping terminal. If desired, another well head can be lowered over the extension 108 and the adapter 86 and connected in an appropriate manner to the pipe stub 4. Then the packer assembly 70 can be released as previously described and removed from the casing 4.

It is within the scope of the present invention that the packer elements 75 and 76 be a combination of different materials, such as an elastomer for the lower element 75 and a relatively soft metal such as copper for the upper element 76. Such a combination would ensure a pack-off under very hostile conditions of high temperatures and pressures. The present invention also finds ready application to offshore wells, where remote controlled cameras would be used to view the apparatus as the methods are performed.

In use of the flow head assembly 159 shown in FIG. 7, the assembly is lowered by a crane or the like down over the casing stub 4 until the lower end of the skirt 165 engages the ground. If needed, additional weights (not shown) can be bolted to the flange 161. As mentioned above, the lower portion of the skirt 165 will sink into the ground somewhat, or can be driven down by suitable means. The ball valve 167 is open, and the ball valve 172 closed, so that the flow of oil issues temporarily out the top of the tube 166 and burns thereabove. Then cement is injected through the connection 163 to fill the annular region between the skirt 165 and pipe 4 to about the level of the top of the pipe, and the cement quickly sets up to provide a barrier which prevents earth materials from being sucked up into the tube 166. When the pipe 170 has been attached to a suitable line, the actuator for ball valves 167, 172 is operated to simultaneously close the upper valve 167 and open the side valve 172 to direct the flow of oil out through the pipe 170 and into a flow line that leads to a gathering pit, storage tank, or tanker. A lubricator can be attached to the top of the vertical pipe 166 to allow inserting various tools into the casing 4 in order to bring the well under normal control.

It now will be recognized that new and improved methods and apparatus have been disclosed for quickly shutting off the flow from a burning oil well. Since certain changes or modifications may be made in the disclosed embodiment without departing from the inventive concepts involved, it is the aim of the appended claims to cover all such changes and modifications that fall within the true spirit and scope of the present invention.

What is claimed is:

1. Apparatus for use in controlling the flow of oil or other products from a well casing, comprising: an elongated first tubular means having a cylindrical upper section, a frusto-conical intermediate section, and a lower skirt section, said lower skirt section being sized to fit over the upper end of said well casing, said upper section extending upward above ground level; port means in said conical section for enabling a hardenable material to be injected thereinto to provide an annular seal between the external walls of said casing upper end and internal walls of said skirt portion; an elongated second tubular means having a downward curved inner end portion and a generally horizontal outer end portion, said inner end being joined to said upper section of said first tubular member and in fluid communication therewith; first valve means in said first tubular means above the joinder with said second tubular means for controlling flow of fluids through said upper section thereof; second valve means in said second tubular means for controlling the flow of fluids therethrough; and means for simultaneously closing and opening said first valve means while opening and closing said second valve means so that both of said valve means are not open or closed at the same time.

2. The apparatus of claim 1 wherein the inner diameter of said cylindrical upper section is larger than the inner diameter of said well casing stub to prevent a back pressure from developing near the lower end of said cylindrical upper section.

3. The apparatus of claim 1 further including weight means fixed to said conical section to stabilize said apparatus as it is being positioned over said well casing.

4. The apparatus of claim 3 wherein said weight means includes an annular flange that extends outward of said conical section, said flange having means for fixing additional weight members thereto.

* * * * *